US009371988B2

(12) United States Patent
Jewett

(10) Patent No.: US 9,371,988 B2
(45) Date of Patent: Jun. 21, 2016

(54) CANDLE ASSEMBLY WITH RETRACTING NON-COMBUSTIBLE WICK

(71) Applicant: Scott E. Jewett, Irvine, CA (US)

(72) Inventor: Scott E. Jewett, Irvine, CA (US)

( * ) Notice: Subject to any disclaimer, the term of this patent is extended or adjusted under 35 U.S.C. 154(b) by 266 days.

(21) Appl. No.: 14/104,195

(22) Filed: Dec. 12, 2013

(65) Prior Publication Data

US 2014/0162201 A1 Jun. 12, 2014

Related U.S. Application Data

(60) Provisional application No. 61/736,139, filed on Dec. 12, 2012.

(51) Int. Cl.
*F23D 3/28* (2006.01)
*C11C 5/00* (2006.01)

(52) U.S. Cl.
CPC .. *F23D 3/28* (2013.01); *C11C 5/006* (2013.01)

(58) Field of Classification Search
CPC ..... F23D 3/28; C11C 5/006
USPC ..... 431/290, 288
See application file for complete search history.

(56) References Cited

U.S. PATENT DOCUMENTS

| | | | | |
|---|---|---|---|---|
| 2,853,866 | A * | 9/1958 | Godshall | F21S 13/00 431/290 |
| 3,121,316 | A | 2/1964 | Wilson et al. | |
| 3,462,235 | A | 8/1969 | Summers | |
| 3,652,197 | A | 3/1972 | Tokarz | |
| 3,730,674 | A | 5/1973 | Gross | |
| 4,755,135 | A | 7/1988 | Kwok | |
| 5,078,591 | A | 1/1992 | Despres | |
| 6,270,340 | B1 | 8/2001 | Lepp | |
| 6,428,311 | B1 | 8/2002 | Bernardo | |
| 6,699,034 | B2 | 3/2004 | Schoeck | |
| 2012/0135359 | A1 | 5/2012 | Thomas et al. | |

FOREIGN PATENT DOCUMENTS

| | | |
|---|---|---|
| DE | 4207847 | 9/1993 |
| EP | 1328757 | 3/2006 |

* cited by examiner

*Primary Examiner* — Avinash Savani
(74) *Attorney, Agent, or Firm* — Russo & Duckworth, LLP; David G. Duckworth

(57) ABSTRACT

An improved candle is provided. The candle includes a traditional body made of wax. A coil spring is positioned longitudinally within the candle's body. The coil spring is in tension with the coil spring's top adjacent to the candle body's top. In addition, the candle includes a non-combustible wick which is not consumed as the candle burns. The wick is affixed to the coil spring's top end. As the candle wick burns and the candle body is consumed, the coil spring causes the wick to retract downwardly.

6 Claims, 3 Drawing Sheets

CANDLE ASSEMBLY WITH RETRACTING NON-COMBUSTIBLE WICK

RELATED APPLICATIONS

The present application is a continuation-in-part of co-pending U.S. Provisional Patent Application Ser. No. 61/736,139 filed on Dec. 12, 2012.

BACKGROUND OF INVENTION

The present invention relates to candles having a non-consumable reusable wick. More particularly, the present invention relates to candles producing a consistent flame as the candle burns.

Traditional candles contain a wick that is made of a consumable material such as cotton, cellulose, hemp, or other fiber materials that may be braided, knitted or woven. Typically, the wick also contains stiffening materials so as to maintain the upper end of the wick in a self-supporting condition. These stiffening materials may include cotton, zinc, or thermoplastic polymers.

When a candle is first lit, a heat source, typically in the form of a match or lighter, melts the wax near the wick. The wax acts as a fuel which is drawn up the wick by capillary action and then burns producing a flame, which in turn, produces light and heat. The heat of the flame then vaporizes the wax which has become liquid. The flame continues to consume the wax until the wax fuel is depleted. For most traditional candles, the wick is also consumable and shortens as the candle burns.

More recently, non-consumable wicks have been introduced. For example, U.S. Pat. No. 3,121,316 describes a non-combustible wick which has a spiral configuration and rests upon the wax body. Meanwhile, U.S. Patent Publication Application No. 2012/0135359 describes a non-consumable wick which can be used both within a wax candle and an oil lamp. U.S. Pat. No. 6,270,340 describes a candle wick having a metal mesh configuration wherein the metal mesh directs the candle wax into the wick so as to be burned. Furthermore, heat from the candle causes the metal mesh to sink into the wax as the candle burns.

Unfortunately, both traditional candles having a consumable wick and more recent candles having a non-consumable wick produce flames that can vary significantly during the burning process. For example, for candles having a consumable wick, the wick can burn too quickly in relation to the candle wax so as to produce a small flame or extinguish the flame altogether. Conversely, a wick that burns too slowly in relation to the candle body will create an ever-increasing flame. Meanwhile, candles having a non-consumable wick will typically produce a changing flame as the source of the fuel burns away.

Thus, there is a significant need for a candle which produces a more consistent flame.

Furthermore, it would be desirable to provide a candle having a reusable wick.

SUMMARY OF THE INVENTION

The present invention addresses the aforementioned disadvantages by providing an improved candle. The candle has a traditional candle body, preferably made of a combustible wax. The body may come in any size or shape, though for simplicity the candle body is described and illustrated herein as having a traditional cylindrical shape with a substantially flat top and flat bottom. However, the cylindrical construction is for exemplification only and acceptable candle body shapes are only limited by one's imagination. The candle body may be made of any wax or wax-like material useful for burning including paraffin, wax, beeswax, tallow or soy. The candle body may also include colored dyes to provide colored candles as well as fragrances to provide fragrant candles. In addition, the candle may include various decorative elements that may be embedded within the candle body which may be seen either prior or while the candle is burning.

As explained in greater detail below, it is important that the candle body be made of a substantially solid material. The term "substantially solid" is meant to be interpreted to mean that the candle body is of a solid nature at typical room temperatures, though it is understood that the wax or wax-like materials of the body will transfer to a liquid or gaseous vapor form at higher temperatures, such as adjacent to the candle flame, to allow for operation of the candle.

The candle further includes a coil spring positioned within the candle's wax body which is preferably made of metal. The coil spring has a top and bottom with the spring's top positioned at, or near, the top of the candle's body. Meanwhile, the coil spring's bottom end is positioned below the coil spring's top end, and preferably directly below the coil spring's top end so that the spring's longitudinal axis is aligned vertically. Importantly, the coil spring is in a tensional state and formed integrally with the candle's body such that the solid nature of the candle's body maintains the coil spring in tension.

The coil spring may be constructed in various shapes and sizes as can be determined by those skilled in the art. Preferably, the coil spring has a spiral construction and has a substantially flat profile when not in tension or compression. The spiral coil spring may be of various shapes including square, oval or round. A preferred spiral coil spring is round so as to form a helical cone shape when in tension.

Furthermore, the candle of the present invention includes a wick which is preferably non-consumable. By "non-consumable", the wick is made of a material which has a burning temperature above the burning temperature of the candle's body so that the wick is not consumed as the candle body burns. The wick is affixed to the coil spring's top end so as to be positioned at or above the candle body's top. The wick may be affixed to the coil spring by tying the wick to the spring, or by using a separate fastener such as a mechanical fastener or temperature resistance adhesive. Mechanical fasteners or adhesives can be determined by those skilled in the art. The top end of the wick extends above the top of the candle's body. Meanwhile, the bottom end of the wick, which is affixed to the coil spring, may also be located exterior to the candle's body. However, it is preferred that the wick extend at least partially into the candle and covered by the candle's top so that the coil spring is not seen. The length of the wick can be determined by those skilled in the art based upon the size of the candle flame that is desired.

In operation, the candle wick is lit in traditional manner using a match, lighter or other ignition source. Wax at the top of the candle body is melted and travels by capillary action up the wick where the wax burns to create a flame. The flame continues to consume the wax. However, the wick maintains its original shape as it is made of a non-consumable material. Because the coil spring is in tension due to the material's memory, the wick is retracted downward as the candle wax is consumed. Throughout the process of the candle burning, the wick's length is maintained the same so as to provide a consistent flame. As the candle wax melts and is consumed, the coil spring incrementally retracts until it reaches its resting state, which is preferably a flat spiral coil located at the candle's base.

Thus, it is an object of the present invention to provide an improved candle which provides a more consistent flame.

Furthermore, it is an object of the present invention to provide a candle having a non-consumable wick which provides a consistent flame.

It is still an additional object of the present invention to provide a candle having a coil spring and wick assembly which is reusable.

DETAILED DESCRIPTION OF THE DRAWINGS

DETAILED DESCRIPTION OF THE INVENTION

Figure 1:
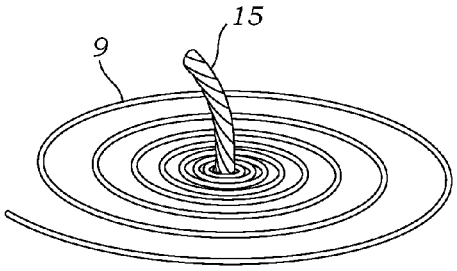
FIG. 1 is a perspective view illustrating the preferred coil spring and wick of the present invention wherein the coil spring is in a rested condition.

While the present invention is susceptible of embodiment in various forms, as shown in the drawings, hereinafter will be described a presently preferred embodiments of the invention with the understanding that the present disclosure is to be considered as an exemplification of the invention and it is not intended to limit the invention to the specific embodiments illustrated.

The candle 1 of the present invention includes three primary elements, namely a body 3, a coil spring 9, and a wick 15. The candle's body 3 has a construction typical of prior art candles and thus preferably includes a flat bottom 7 for resting on flat surfaces and a top 5. The candle body 5 may be of any shape. However, an exemplary candle shape has a cylindrical sidewall as illustrated in the figures. The candle body 5 is made of a material that is traditional to candle making such as paraffin, wax, beeswax, tallow and/or soy. However, the candle is made of a substantially solid material as opposed to a liquid material such as an oil used in an oil lamp.

Figure 2:
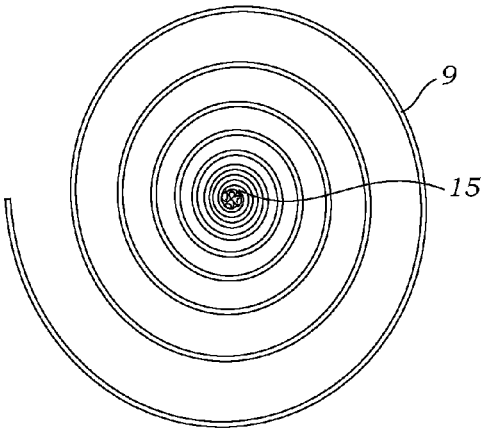
FIG. 2 is a top plan view of the coil spring and wick illustrated in FIG. 1.
Figure 3:
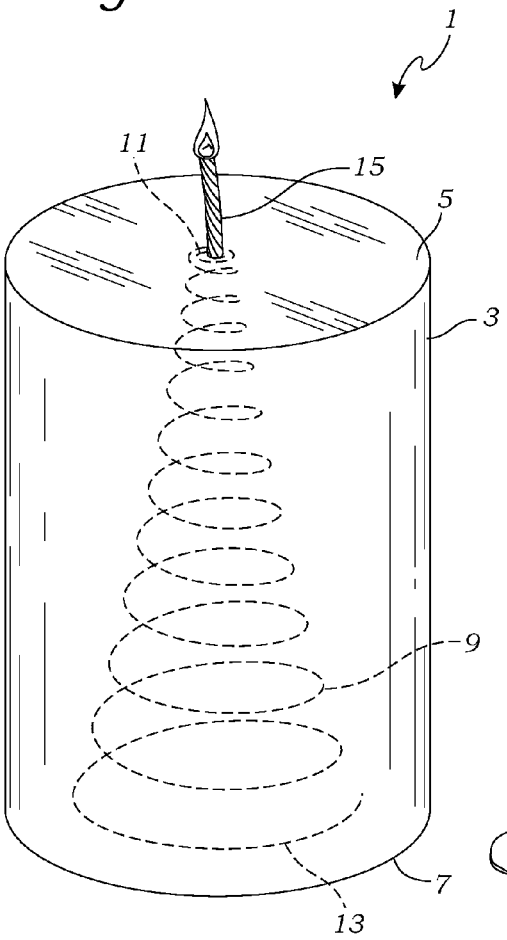
FIG. 3 is a perspective view of the preferred candle of the present invention.
Figure 4:
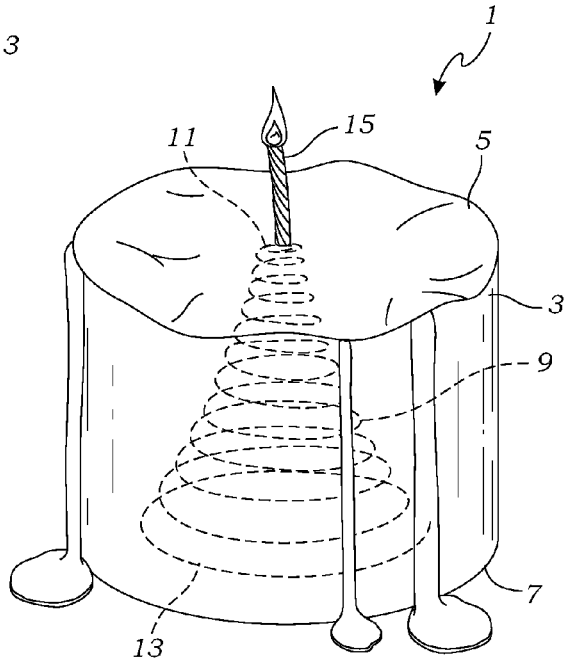
FIG. 4 is a perspective view of the preferred candle of the present invention wherein the candle of FIG. 3 has melted causing the coil spring and wick to retract.

Importantly, and as best illustrated in FIGS. 1, 2, 5 and 8, the candle 1 includes a coil spring 9. As illustrated in FIGS. 3, 6 and 9, the coil spring is positioned longitudinally within the candle wax's body so that the coil spring's top 11 is adjacent to the candle body's top 5. Preferably, but not necessarily, the coil spring's bottom 13 is positioned near the candle body's bottom 7. Of course, the coil spring 9 may be constructed to not be of sufficient length or positioned such that the coil spring's bottom 13 extends all the way to the bottom of the candle, such as where it is desired that the candle not burn entirely. Furthermore, though it is preferred that the coil spring be positioned such that its longitudinal axis is aligned vertically, the coil spring may be positioned in a sloped condition for a candle which is constructed to burn downwardly at an angle.

The coil spring 9 may be any material that can withstand the heat from a nearby flame and which provides sufficient mechanical memory so as to be capable of deforming and retracting substantially to its original state. Spring steels which are low-alloy, medium-carbon or high-carbon steels are considered ideal due to their high yield strength and capability of returning to their original shape despite significant bending or twisting. Stainless steels including Type 302 stainless steel are also considered acceptable for use as a coil spring. A preferred steel coil spring has a diameter of 0.008-0.009 inch. As illustrated in FIGS. 1 and 2, it is preferred that the coil spring have a flat spiral shape when in a rested non-tensioned configuration. However, when assembled within the candle body 3, the coil spring 9 is elongated to form a helical cone shape with the coil spring's top 11 adjacent to the candle body's top 5.

The candle 1 of the present invention further includes a wick 15. The wick 15 is affixed to the coil spring's top 11. The wick 15 may be affixed to the spring using various fastening methods known to those skilled in the art such as by simply tying the wick to the end of the coil spring 9. Alternatively, metal fasteners such as metal wire can be wrapped around the wick and the coil spring's end. In still another construction would employ an adhesive which is sufficiently resistant to the heat from the candle's nearby flame.

Preferably, the wick 15 is not combustible at the temperatures at which the candle body burns. More specifically, the wick is made of a material which has a burning temperature such that it is not combustible at the burning temperature at the candle's body so that the wick is not consumed as the candle is lit and as the candle burns. Acceptable materials include ceramic fibers available from 3M Company. The ceramic fibers are then woven into a twine or string and then cut to a desired length. The length of the width 15 can be determined by those skilled in the art based upon the size of the flame that is desired.

To manufacture the candle 1 of the present invention, the candle is formed in a mold, or jar or votive to be sold with the candle. One end of the coil spring 9, such as a coil spring illustrated in FIGS. 1 and 2, is affixed to the bottom of the mold, jar or votive. The top end 11 of the coil spring is stretched upwardly to its proper condition as illustrated in FIG. 3. Melted wax is poured into the mold, jar or votive and allowed to cool. Once cooled, the wax forms the candle's body 3 which maintains the coil spring in a tensional condition.

Figure 5:
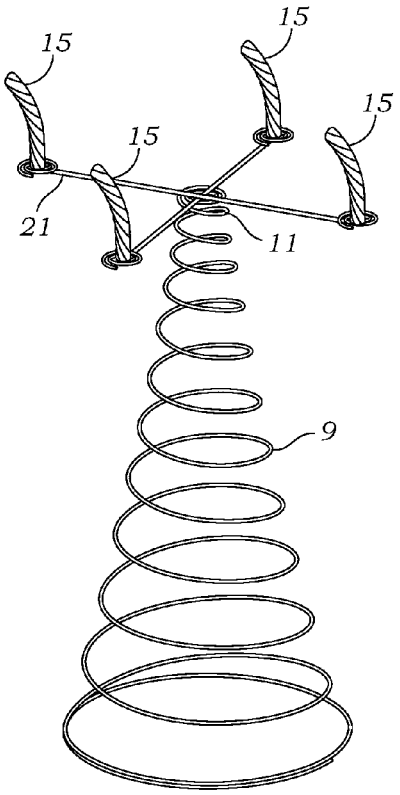
FIG. 5 is a perspective view of an alternative embodiment of a coil spring and wick assembly of the present invention including four (4) wicks.
Figure 6:
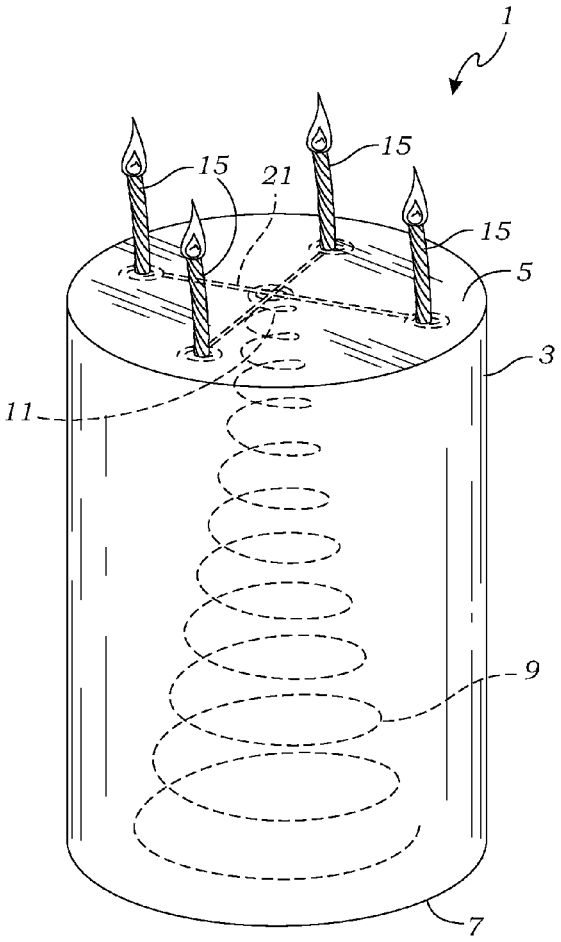
FIG. 6 is a perspective view of a candle of the present invention including four (4) wicks.
Figure 7:
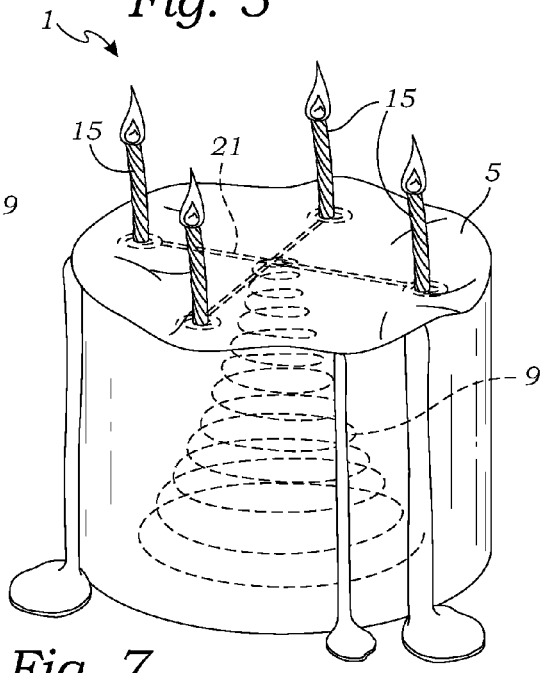
FIG. 7 is a perspective view of the candle shown in FIG. 6 which has melted causing the coil spring and four (4) wicks to retract.

As illustrated in FIGS. 5-10, there are various embodiments of the candle of the present invention. For example, FIGS. 5-7 illustrate a construction wherein a single candle 1 includes a single coil spring 9 which controls the retraction of four wicks 15 as the candle burns. This construction includes a support frame 21 which affixes to the coil spring's top 11. In turn, a plurality of wicks 15, in this case four wicks 15, are affixed to the opposing arms of the support frame 21. As illustrated in FIG. 7, as the candle melts the coil retracts pulling the support frame 21 and accompanying wicks 15 downwardly.

Figure 8:
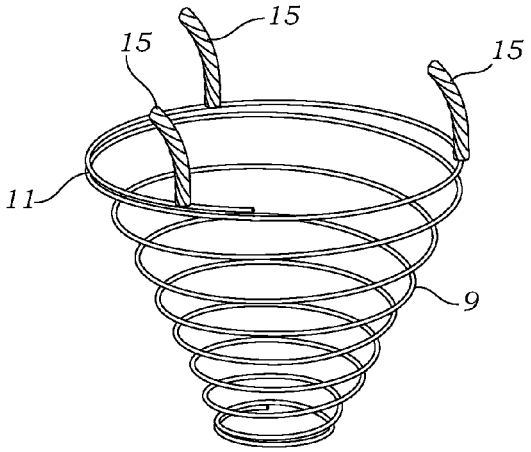
FIG. 8 is a perspective view of a coil spring affixed to three (3) wicks for use within a candle of the present invention.
Figure 9:
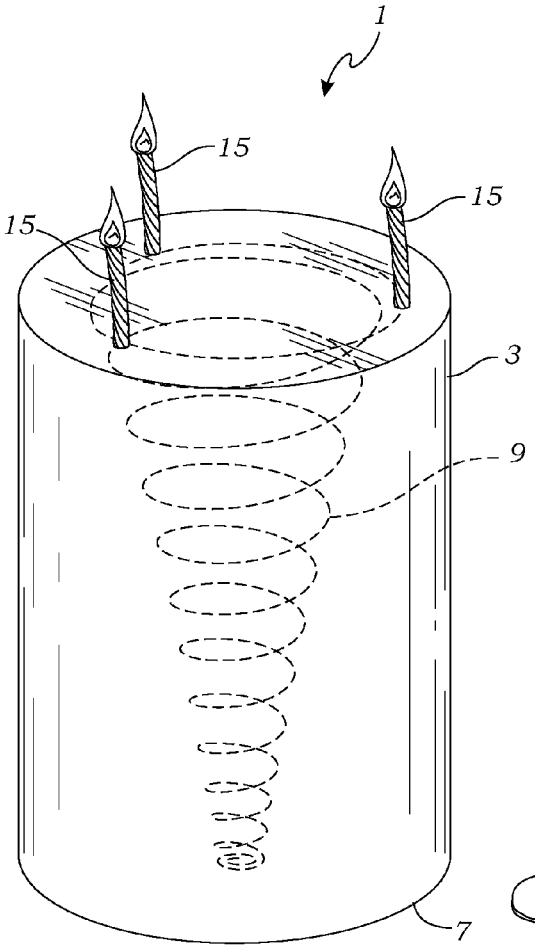
FIG. 9 is a perspective view of a candle of the present invention including three (3) wicks.
Figure 10:
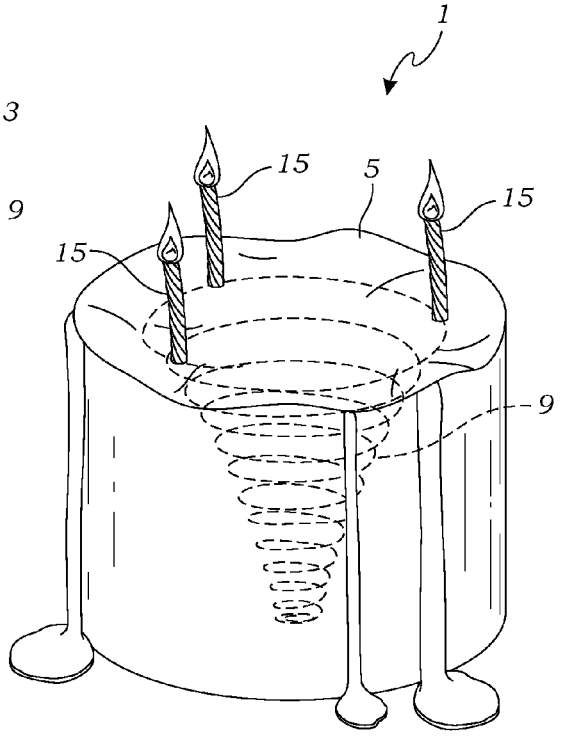
FIG. 10 is a perspective view of the candle shown in FIG. 9 which has melted causing the coil spring and three (3) wicks to retract.

In still an alternative embodiment illustrated in FIGS. 8-10, the candle 1 includes a coil spring similar to the coil springs illustrated in FIGS. 1-7. However, the coil spring has been inverted within the candle's body 3 so that the smaller diameter section of the coil spring is positioned at the candle body's bottom 7 and the larger diameter portion of the coil spring 9 is located at the candle body's top 5. A plurality of wicks, in this case three, are affixed at various points around the coil spring's larger diameter at the candle body's top. Like previous embodiments, as the candle wicks burn the candle body is consumed and the coil spring and wicks are retracted downwardly.

While several particular forms of the invention have been illustrated and described, it will be apparent that various modifications can be made without departing from the spirit and scope of the invention. Therefore, it is not intended that the invention be limited except by the following claims. Having described my invention in such terms as to enable a person skilled in the art to understand the invention, recreate the invention and practice it, and having presently

I claim:

1. A candle comprising: a body made of a flammable substantially solid material; a wick positioned at the top of said body; and a coil spring having a top and a bottom formed within said body, said spring's top affixed to said wick and said spring being positioned vertically and in tension within said body so that said spring's top and said wick will retract downward if the top of said body burns; wherein said coil spring is helical and having a substantially flat spiral profile in a resting non-compression/non-tension condition so as to retract from a helical cone shape to a flat spiral condition as said candle body is burned.

2. The candle of claim 1 wherein said wick has a burning temperature above the burning temperature of said body so that said wick is substantially non-consumable as said body burns.

3. The candle of claim 1 wherein said coil spring is metal.

4. The candle of claim 1 wherein said body is made of wax.

5. The candle of claim 1 wherein said wick is ceramic.

6. A candle comprising: a body made of wax; a wick positioned at the top of said body, said wick having a burning temperature above the burning temperature of said body so that said wick is substantially non-consumable as said body burns; and a metal helical cone shaped coil spring having a top and a bottom formed within said body, said spring's top affixed to said wick, and the bottom of the spring helically extends to a bottom of said body and said spring positioned vertically and in tension within said body so that said spring's top and said wick will retract downward if the top of said body burns.

* * * * *